US006280245B1

(12) United States Patent
Han

(10) Patent No.: US 6,280,245 B1
(45) Date of Patent: Aug. 28, 2001

(54) DUAL CONTACT POWER CONNECTOR

(75) Inventor: Hannah Han, Fremont, CA (US)

(73) Assignee: TVM Group, Inc., Fremont, CA (US)

( * ) Notice: Subject to any disclaimer, the term of this patent is extended or adjusted under 35 U.S.C. 154(b) by 0 days.

(21) Appl. No.: 09/615,661

(22) Filed: Jul. 14, 2000

Related U.S. Application Data

(60) Provisional application No. 60/154,406, filed on Sep. 17, 1999.

(51) Int. Cl.[7] ..... H01R 13/60

(52) U.S. Cl. ..... 439/541.5; 439/947

(58) Field of Search ..... 439/541.5, 947, 439/78, 79, 80, 748, 540.1, 525, 526, 69, 70

(56) References Cited

U.S. PATENT DOCUMENTS

| | | | | |
|---|---|---|---|---|
| 4,612,602 | * | 9/1986 | Weyer et al. | 361/394 |
| 4,695,116 | | 9/1987 | Bailey et al. | 439/188 |
| 4,884,237 | * | 11/1989 | Mueller et al. | 365/63 |
| 5,051,870 | * | 9/1991 | Companion | 361/405 |
| 5,807,120 | * | 9/1998 | Matthews | 439/80 |
| 6,077,087 | * | 6/2000 | Endres et al. | 439/63 |

FOREIGN PATENT DOCUMENTS 0546505 6/1994 (EP) .

* cited by examiner

*Primary Examiner*—Tulsidas Patel
*Assistant Examiner*—Son V. Nguyen
(74) *Attorney, Agent, or Firm*—Flehr Hohbach Test Albritton & Herbert LLP

(57) ABSTRACT

A multiple socket power connector assembly for use with a printed circuit board having at least one first trace extending to an array of first interconnect holes in the printed circuit board and at least one second trace extending to an array of second interconnect holes in the printed circuit board. The connector assembly comprises a connector housing having a base and a wall extending upwardly from the base. First and second conductive sockets are carried by the connector housing in vertically spaced-apart positions relative to the base and are accessible from the wall. A first set of pin members extending from the base and electrically coupled to the first conductive socket engage the array of first interconnect holes in the printed circuit board. A second set of pin members extending from the base and electrically coupled to the second conductive socket engage the array of second interconnect holes in the printed circuit board.

20 Claims, 6 Drawing Sheets

DUAL CONTACT POWER CONNECTOR

CROSS-REFERENCE TO RELATED APPLICATIONS

This application claims the benefit of U.S. provisional application Ser. No. 60/154,406 filed Sep. 17, 1999, the entire contents of which are incorporated herein by this reference.

BRIEF DESCRIPTION OF THE INVENTION

This invention relates to electrical connector assemblies and more particularly to electrical connector assemblies for power distribution and signal transmission.

BACKGROUND OF THE INVENTION

Connector assemblies have heretofore been used for providing power connections to and between printed circuit boards. See, for example, U.S. Pat. No. 5,807,120. Pins and sheets or other male electrically conductive bodies are utilized in such connector assemblies for transmitting electrical energy. Traditionally, when multiple power inputs are desired for a single circuit board the connector assemblies are mounted side by side. The traditional approach requires as much extra space on the circuit board, for each extra connector, as the space a single connector requires.

There is a need for small connector assemblies providing multiple power connections for a circuit board. An improved connector assembly would ideally have a small footprint and have a small profile with respect to the printed circuit boards. An improved connector assembly would also require less extra space on the circuit board, for each extra connector, than the space required for a single connector.

SUMMARY OF THE INVENTION

A multiple socket power connector assembly for use with a printed circuit board having at least one first trace extending to an array of first interconnect holes in the printed circuit board and at least one second trace extending to an array of second interconnect holes in the printed circuit board. The connector assembly comprises a connector housing having a base and a wall extending upwardly from the base. First and second conductive sockets are carried by the connector housing in vertically spaced-apart positions relative to the base and are accessible from the wall. A first set of pin members extending from the base and electrically coupled to the first conductive socket engage the array of first interconnect holes in the printed circuit board. A second set of pin members extending from the base and electrically coupled to the second conductive socket engage the array of second interconnect holes in the printed circuit board.

DETAILED DESCRIPTION OF THE INVENTION

Reference will now be made in detail to the preferred embodiment of the invention which is illustrated in the accompanying figures. The description of the embodiment of the invention will be followed by a discussion of its operation.

Figure 1:
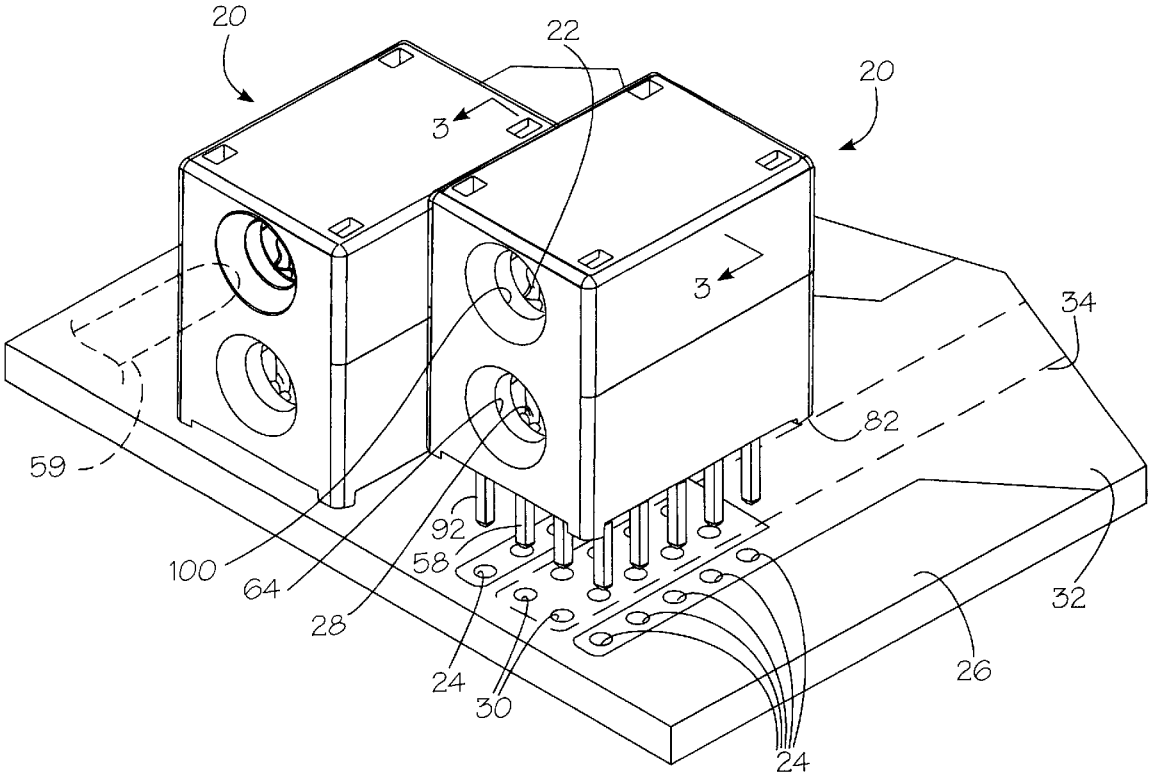
FIG. 1 is a perspective view of a first embodiment for two dual contact power connectors of the present invention, one mounted on a printed circuit board and the other in an unengaged position with respect to the printed circuit board.

One embodiment of the of the present invention is multiple socket power connector assembly 20, which serves to transmit power between first conductive socket 22 and first trace 32 on printed circuit board 26, as well as between second conductive socket 28 and second trace 34 (see FIG. 1). First interconnect holes 24 are electrically coupled to first trace 32 on the top side of printed circuit board 26, while second interconnect holes 30 are electrically coupled to second trace 34 on the bottom side of printed circuit board 26. In one preferred embodiment, ten second interconnect holes 30 are provided in second trace 34 and are longitudinally spaced-apart in two arrays of five holes. The holes 30 are aligned side-by-side to form pairs of interconnect holes. Two arrays of five first interconnect holes 24 are provided in first trace 32 and are located alongside second interconnect holes 30. Printed circuit board 26 is of a conventional design and is formed from a planar sheet made from any suitable material such as glass reinforced epoxy laminate (FR4). A plurality of two or more connector assemblies 20 are disposed side-by-side on circuit board 26. Other dispositions for socket connectors 20 are possible. FIG. 1 illustrates connector assembly 20 with a pin 92 protruding through interconnect hole 24 on printed circuit board 26.

Figure 4:
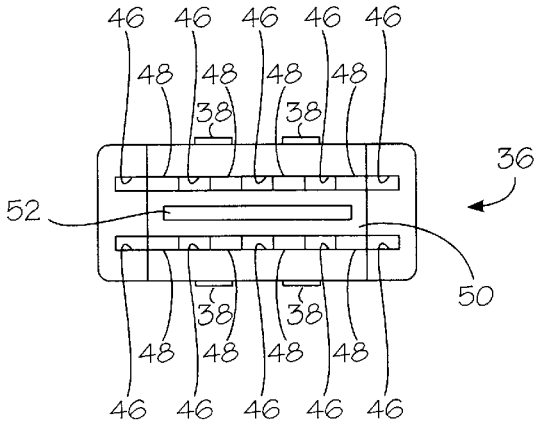
FIG. 4 is a top plan view of the base of a dual contact power connector of FIG. 1 taken along the line of 4—4 of FIG. 2.
Figure 2:
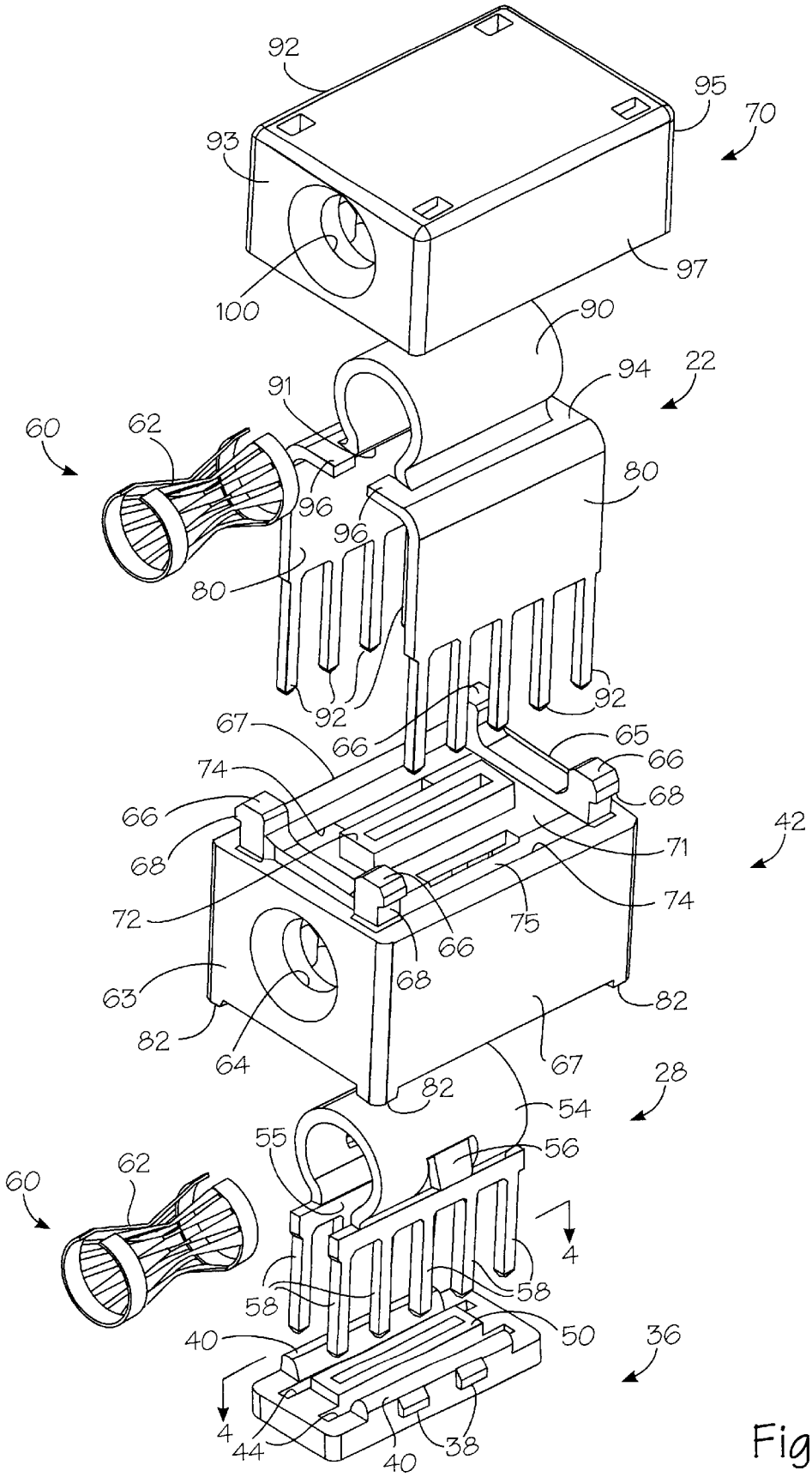
FIG. 2 is an exploded perspective view of a dual contact power connector of FIG. 1.
Figure 3:
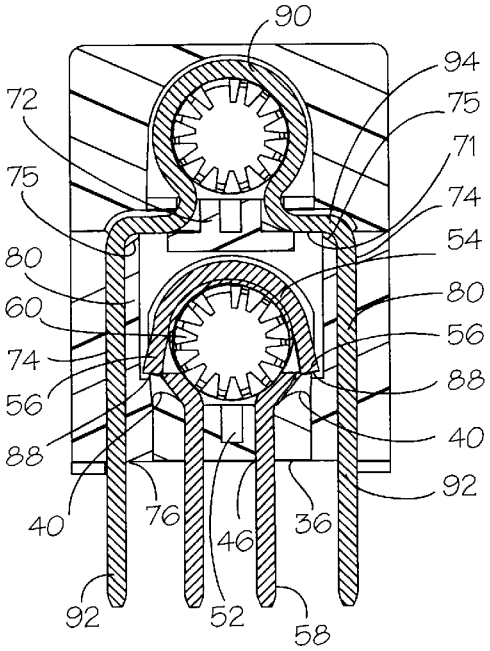
FIG. 3 is a cross-sectional view of a dual contact power connector of FIG. 1 taken along the line 3—3 of FIG. 1.

Base connector assembly 20 has a base 36 formed from any suitable electrically insulating material such as plastic (see FIGS. 2, 3, and 4). Two raised bodies or ridges 40 extend along the length on the top of base 36 and form a support for second or bottom conductive socket 28. Two catches 38 extend from the ridge of each of raised bodies 40. Two partial slots 44 are formed in base 36 adjacent to ridges 40 and run the length of base 36. Each slot 44 projects into but not all the way through base 36 and terminates in four base-bridges 48. Five base-holes 46 extend between bridges 48 to the bottom of base 36. Partition 50 rises from the center of base 36 and surrounds a cavity 52 that terminates short of the bottom of base 36. Base 36 is formed to slidably engage the bottom of a first or lower housing 42. In the embodiment illustrated, base 36 has a length of approximately 0.510 inch, a width not including catches 38 of approximately 0.220 inch, and a height including ridges 40 of approximately 0.094 inch.

Lower conductive socket 28 is formed from a stamped and formed, electrically-conducting member, although other methods of manufacturing are possible (see FIGS. 1, 2, and 3). Lower socket 28 comprises a partial second tube 54 with an opening 55 formed at its bottom. Wings 56, formed integral with tube 54, extend down and out from each side of tube 54. The sides of tube 54 terminate at opening 55, leading to ten downward extending second pins, or prongs 58 formed integral with the tube 54. Five second pins 58 extend from each side of tube 54. The distance between a second pin 58 on one side of second tube 54 and an immediately adjacent second pin 58 on the other side of tube 54 is approximately 0.100 inch. One embodiment uses Elcon Products part no. 259-0193-02207 for lower socket 28.

A crown contact 60, formed from an electrically-conducting member, is sized to fit within tube 54 of lower socket 28 (see FIG. 2). Crown contact 60 is hourglass-shaped in form and has a plurality of longitudinally extending and spaced apart flexible contact members 62. The illustrated embodiment uses Elcon Products part no. 703-25-02205 for crown contact 60. Similarly sized and shaped parts are available through Elcon Products, Slimline Iccon parts, product no. 259-0195-00500. Second tube 54 slidably receives crown contact 60 such that the contact 60 is centered within the tube 54.

Lower socket 28 slidably engages base 36 such that each second pin 58 of lower socket 28 is received by partial slots 44 and each second pin 58 extends through a base hole 46. The lower outer portion of second tube 54, beneath wings 56, contacts and is supported by ridges 40 of base 36 (see FIG. 3).

Hollow lower housing 42 (see FIGS. 1, 2, 3, and 5) is made from any suitable electrically insulating material such as plastic. Lower housing 42 has a front wall 63, a rear wall 65, and two side walls 67. Two lower portals 64 are circular and one portal is located on each of front wall 63 and rear wall 65. Lower portals 64 are longitudinally opposed to one another and form an entrance into cavity 69 of lower housing 42 (see FIG. 5). Lower portals 64 are guides for plug or pin power couplings, such as male connector or pin 59, shown in FIG. 1, insertable into second socket 28. On the top of lower housing 42 are four posts 66 with catches 68 designed to secure lower housing 42 and an upper housing 70. Posts 66 are integral with lower housing 42. Lower housing 42 has a top support surface 71 that extends longitudinally across lower housing 42 but ends laterally in angled ramps 75 leading into partial upper slots 74. In the center of support surface 71 is upstanding guide 72 that serves to position first socket 22. Alongside guide 72 and running the length of lower housing 42 are partial upper slots 74, parallel with the sides of lower housing 42, that extend downward and into, but not all the way through, lower housing 42 and terminates in four housing-bridges 78. Five housing holes 76 extend between bridges 48 to the bottom of lower housing 42. Four standoffs 82 are integrally formed with lower housing 42 and extend from the bottom corners of lower housing 42 approximately 0.020 inch. Lower housing has a length from 0.610 inch to 0.700 inch long, but approximately 0.620 inch long, a width from 0.440 inch to 0.495 inch, but approximately 0.450 inch wide, and approximately 0.350 inch high.

Figure 5:
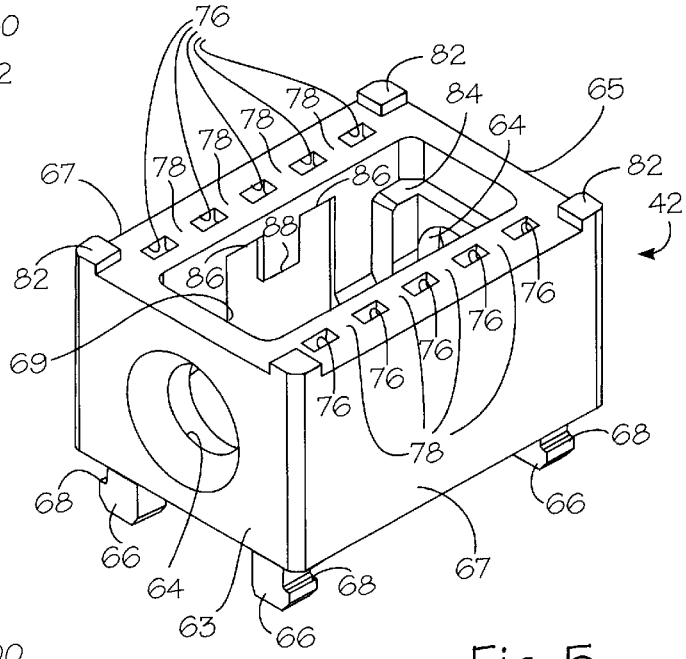
FIG. 5 is a bottom perspective view of the lower housing of a dual contact power connector of FIG. 1.
Figure 6:
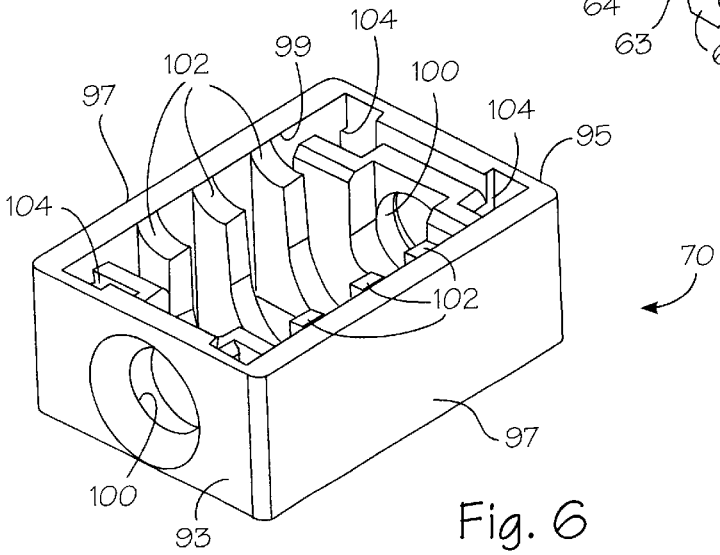
FIG. 6 is a bottom perspective view of the upper housing of a dual contact power connector of FIG. 1.

Within cavity 69 of lower housing 42, a ledge 84 adjacent to each portal 64 extends inward to form a support for base 36 (see FIG. 5). Additionally, two base-latches 86 are provided adjacent to each upper slot 74, totaling four base-latches 86, two on each side of the cavity within lower housing 42. Base-latches 86 are recessed within the cavity. Between each pair of base-latches 86 is a socket-latch 88, also recessed within cavity 69. FIG. 5 shows only one of two pairs of base-latches 86 and one of two ledges 84.

Base 36, along with slidably mounted lower socket 28, are slidably received into the cavity in lower housing 42. Catches 38 of base 36 engage base-latches 86 of lower housing 42 when base 36 encounters ledges 84. Base 36 is fixedly held within lower housing 42 by catches 38, base-latches 86 and ledges 84. Bottom of base 36 lies flush with the bottom of lower housing 42 when fully engaged. Socket-latches 88 engage wings 56 of second socket 28 and hold second socket 28 in a secure position within lower housing 42. Second socket 28 is aligned with lower portal 64 in order to receive male connector 59.

First or upper conductive socket 22 is formed from a stamped and formed, electrically-conducting member, although other methods of manufacturing are possible (see FIGS. 1, 2, and 3). Upper socket 22 comprises a partial first tube 90 with an opening 91 formed at its bottom. The sides of tube 90 terminate at opening 91, forming support bed 94 with fingers 96 extending towards one another. Support bed 94 is shaped and formed to extend downward into parallel sheets 80. First pins 92 integral with sheets 80 extend downward at the termination of sheets 80. Five first pins 92 extend from each sheet 80. The distance between pins 92 on one sheet 80 and pins 92 on the other sheet 80 is from 0.310 to 0.420, but approximately 0.320 inch.

Crown contact 60 is received by first tube 90 in a similar manner to second tube's 54 reception of crown contact 60.

Upper socket 22 sits upon the top of lower housing 42. Upper slots 74 are sized to receive sheets 80 of first socket 22. Upper partial slots 74 guide first pins 92 into lower housing 42. First pins 92 are further guided by housing holes 76 while upper slots 74 guide sheets 80 once first socket 22 is inserted into lower housing 42 a sufficient amount. First socket 22 is fully received by lower housing 42 when support bed 94 comes to rest against support surface 71, and fingers 96 of first socket 22 engage the ends of guide 72. A first pin 92 and the nearest second pin 58 are between 0.100 inch and 0.150 inch apart, but approximately 0.110 inch.

Hollow upper housing 70 is made from any suitable electrically insulating material such as plastic (see FIGS. 1, 2, 3, and 6). Upper housing 70 has a front wall 93, a rear wall 95, and two side walls 97. Two upper portals 100 are circular and one portal is located on each of front wall 93 and rear wall 95. Upper housing 70 has two longitudinally opposed upper portals 100 designed to form an entrance into cavity 99 of upper housing 70. Upper portals 100 are guides for plug or pin power couplings (see connector 59 of FIG. 1) insertable into first socket 22. Cavity 99 of upper housing 70 has ribs 102 that provide support to upper housing 70 as well as position first socket 22 within the interior of upper housing 70. Four engageable receptors 104 are recesses within cavity 99 in the lower corners of the interior of upper housing 70. Receptors 104 are shaped and sized to accommodate posts 66 of lower housing 42. Upper housing 70 has a length from 0.610 inch to 0.700 inch, but approximately 0.620 inch, a width from 0.440 inch to 0.495 inch, but approximately 0.450 inch, and a height of approximately 0.275 inch.

First socket 22 fits into the interior of upper housing 70 when upper housing 70 and lower housing 42 are fitted together. Posts 66 slidably engage receptors 104 until catches 68 lock into receptors 104. First socket 22 is aligned with upper portal 100 in order to receive a plug or pin (see connector 59 of FIG. 1). Connector assembly 20 has a length from 0.610 inch to 0.700 inch, but approximately 0.620 inch, a width from 0.440 inch to 0.495 inch, but approximately 0.450 inch, and a height including standoffs 82 but not including first pins 92 or second pins 58 from 0.615 inch to 0.805 inch, but approximately 0.625 inch.

Power connector assembly 20 mounts to a printed circuit board 26 by inserting pins 92 and 58 into interconnect holes 24 and 30. Connector assembly 20 slidably receives plug power coupling 59 into each of upper and lower sockets 22 and 28 within upper and lower housings 70 and 42. Electricity flows between a power coupling in upper socket 22 and trace 32, as well as between a power coupling in lower socket 28 and trace 34.

Figure 7:
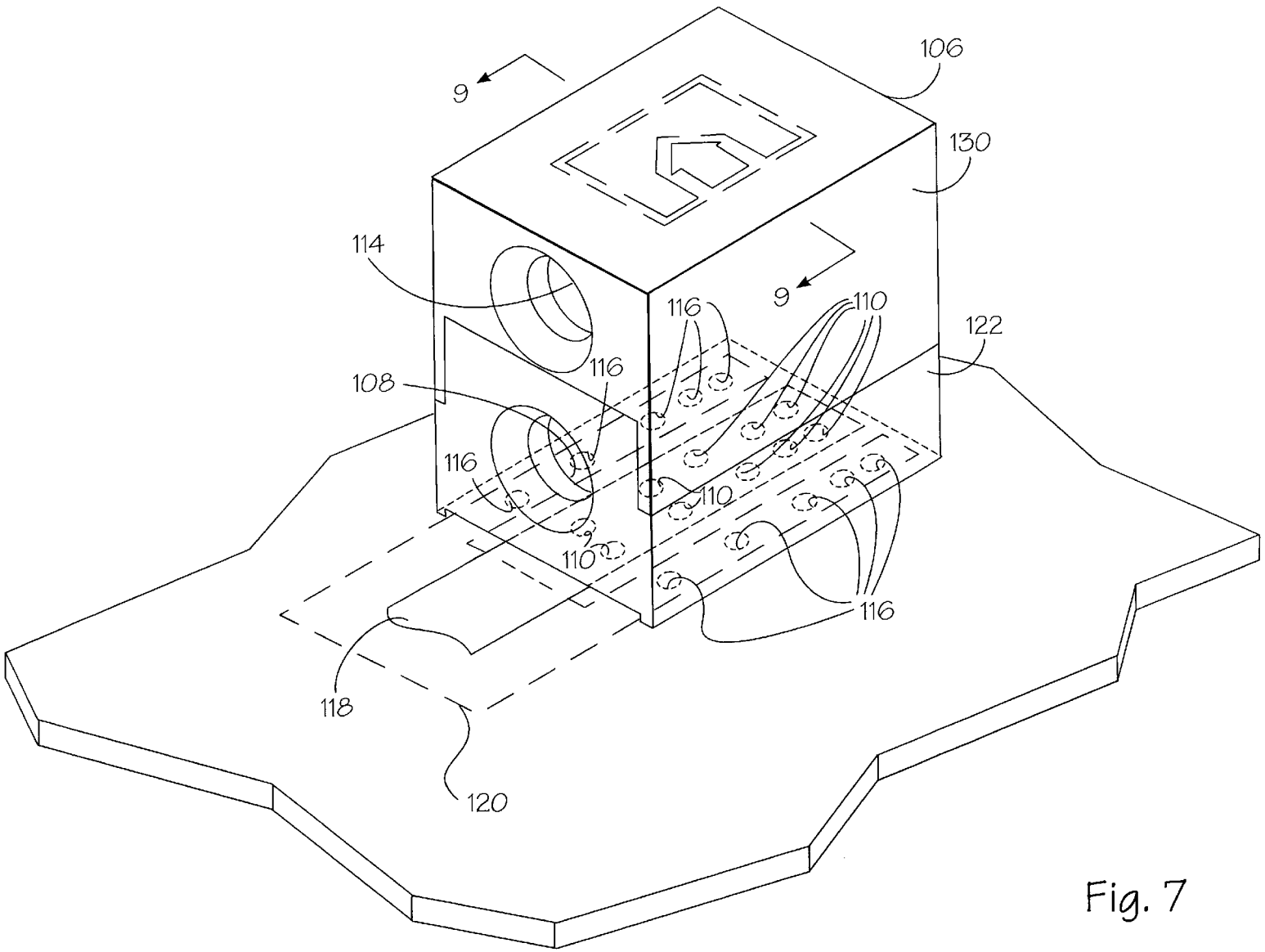
FIG. 7 is a perspective view of a second embodiment for a dual contact power connector of the present invention.
Figure 8:
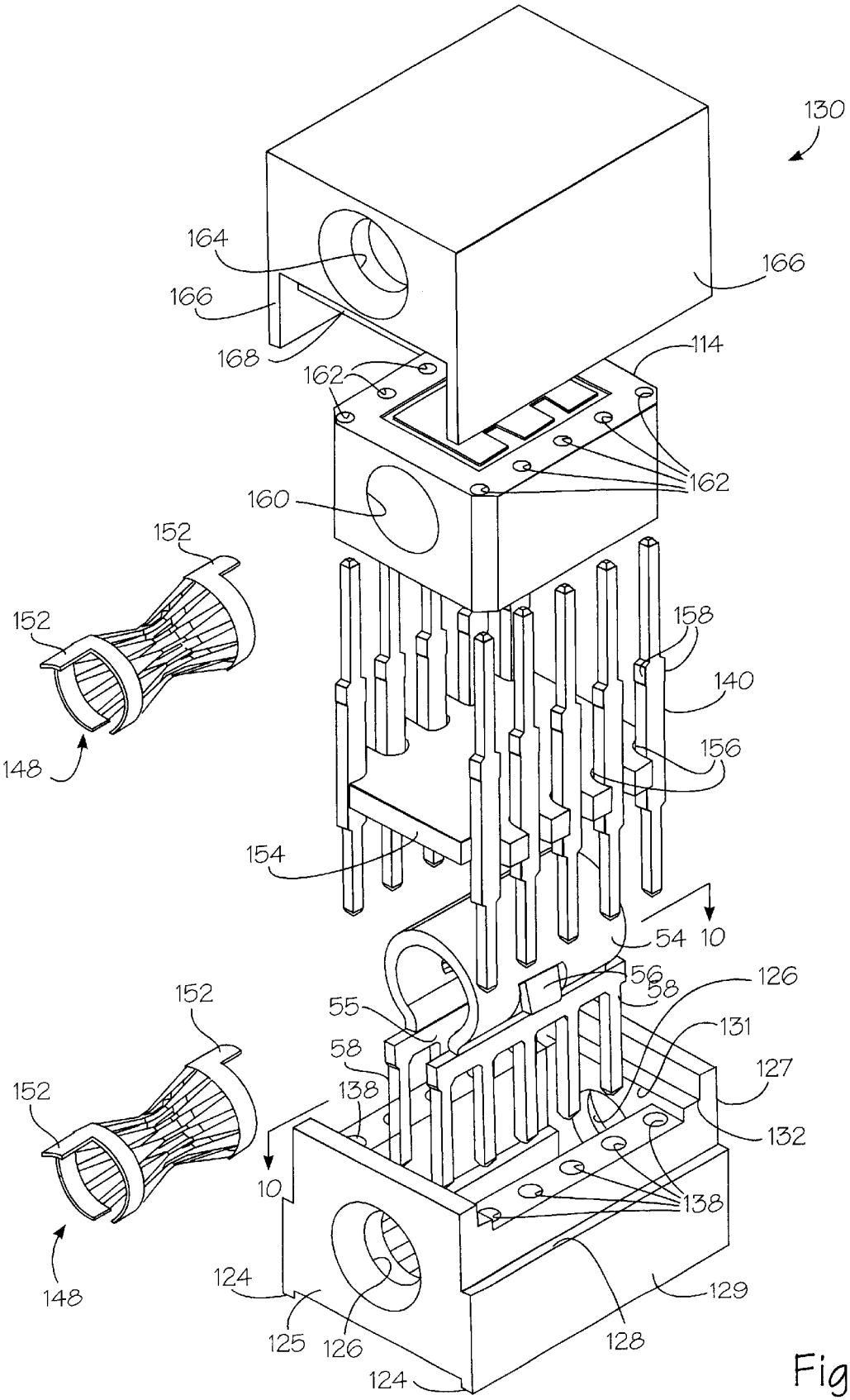
FIG. 8 is an exploded perspective view of the dual contact power connector of FIG. 7.
Figure 9:
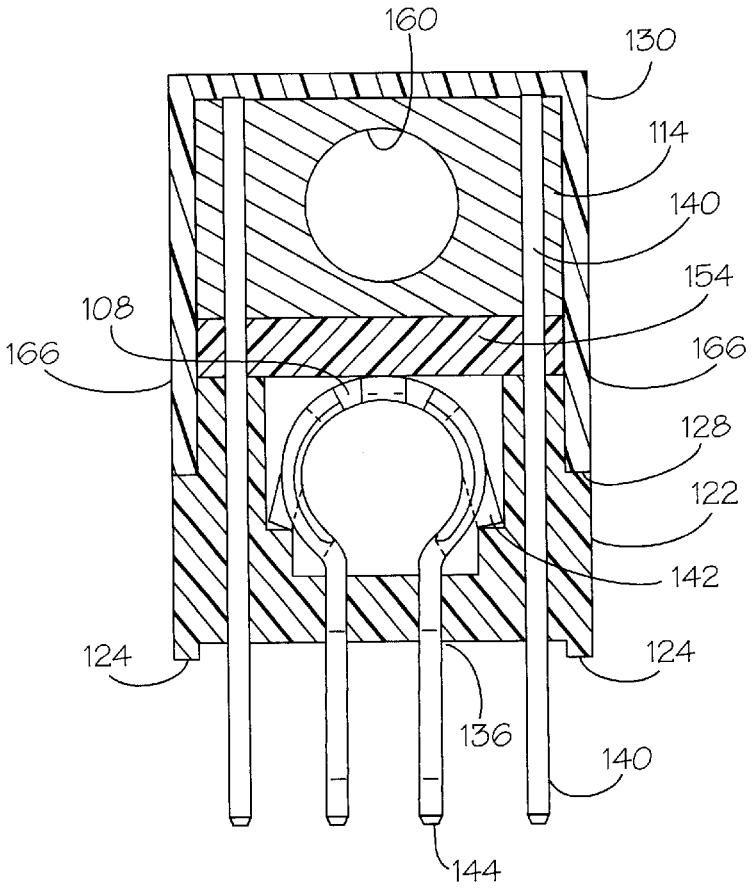
FIG. 9 is a cross-sectional view of the multiple socket assembly of FIG. 7 taken along the line 9—9 of FIG. 7.
Figure 10:
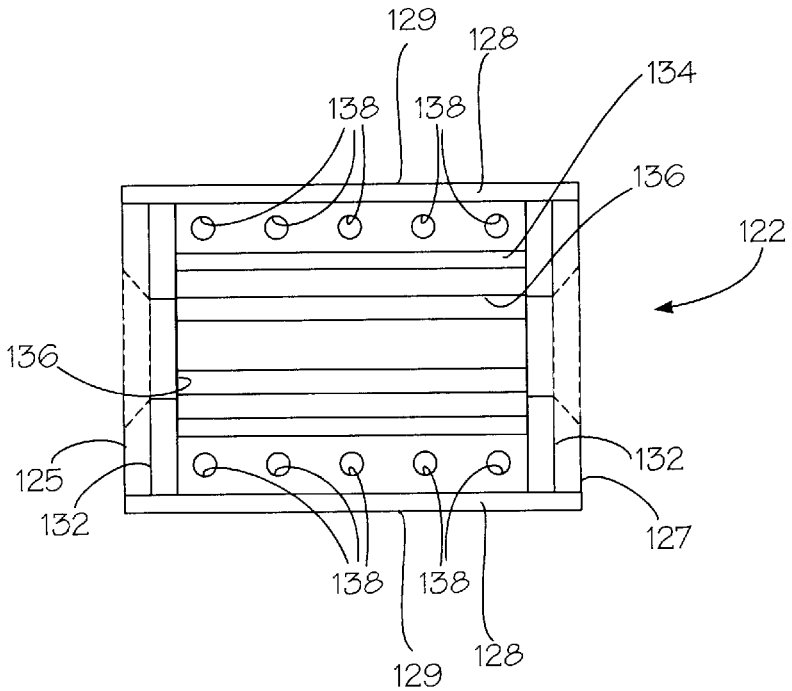
FIG. 10 is a top plan view of the lower housing of the multiple socket assembly of FIG. 7 taken along the line 10—10 of FIG. 8.

An alternate embodiment of the present invention is multiple socket assembly 106, which is similar in many respects to multiple socket power connector assembly 20. Like reference numerals have been used to describe like components of connector assemblies 20 and 106 serves to transmit power between lower socket 108 and third trace 118 on second printed circuit board 112, as well as between upper socket 114 and fourth trace 120 (see FIG. 7). First circuit holes 110 are electrically coupled to third trace 118 on the top side of second printed circuit board 112, while second circuit holes 116 are electrically coupled to fourth trace 120 on the bottom side of second printed circuit board 112. Circuit holes 110 and 116 engage pins 58 and 140. Second printed circuit board 112 has similar form and function as printed circuit board 26, and power flow as well as method of mounting connector assembly 20 to printed circuit board 26 is similar to the method used with multiple socket assembly 106.

First or lower housing 122 is formed from any suitable electrically insulating material such as plastic (see FIGS. 7–10). Hollow lower housing 122 has a rectangular cross-section. A leg 124 protrudes from each of the bottom four corners of first housing 122. Lower housing 122 has a front wall 125, a rear wall 127, and two side walls 129. Two lower openings 126 are circular and one opening is located on each of front wall 125 and rear wall 127. Lower openings 126 are longitudinally opposed in first housing 122 and form entrances into cavity 131 of lower housing 122. Two first ledges 128 extend from first housing 122, laterally oppose one another and are parallel to one another. First ledges 128 support and assist in securing second housing 130. Lower grooves 132 are parallel and longitudinally opposed to one another and also serve to support and secure second housing 130. Second ledges 134 are parallel to one another and are laterally opposed. Second ledges 134 extend into cavity 131 near the bottom of first housing 122. Second ledges 134 support lower socket 108. Slots 136 are parallel and laterally opposed to one another. Slots 136 are located in the bottom of first housing 122, penetrate the bottom of first housing 122 and serve to guide and support socket 28. Two arrays of wells 138 are laterally opposed to one another and adjacent to first ledges. Wells 138 penetrate lower socket 122 through to the bottom. There are ten wells 138 sized and shaped to engage free pins, or pins 140.

In this embodiment, lower socket 28 is identical to second socket 28 of the first embodiment. Lower socket 28 has socket wings 56, socket pins 58, and socket tube 146.

In this embodiment, crown band 148 is similar to crown contact 60. Protrusions 152 extend off the ends of crown bands 148 and serve to prevent crown bands 148 from shifting once socket assembly 106 is constructed.

Lower crown band 148 slidably inserts into lower socket 108. Lower socket 108 lowers into first housing 122 such that the socket pins 144 on one side of lower socket 108 fit into one slot 136 and the socket pins 144 on the other side fit into the other slot 136. Socket wings 142 rest on and are supported by second ledges 134. Socket tube 146 aligns with lower opening 126 in order to receive a plug or pin power coupling (see connector 59 of FIG. 1).

Spacer 154 is flat and has U-shaped notches 156. Spacer 154 is made from any suitable electrically insulating material and sits atop first housing 122. Notches 156 are laterally opposed to one another and line up with wells 138.

Free pins 140 are electrically conducting and cylindrical in shape. Free pins 140 have pin ledges 158 that assist free pins 140 in fixedly engaging wells 138 when free pins 140 are inserted into first housing 122. U-shaped notches 156 are sized and shaped to receive free pins 140.

Upper socket 114 is electrically conducting and has a cylindrical cavity 160 for receiving upper crown band 150. Upper socket is rectangular in shape and has passages 162 sized and shaped to receive free pins 140.

Upper socket 114 slidably receives upper crown band 150. Aligning a free pin 140 with each passage 162 enables upper socket 114 to slidably engage free pins 140 and mount spacer 154.

Hollow second housing 130 is made from any suitable electrically insulating material such as plastic. Upper openings 164 laterally oppose one another and are positioned to align with cavity 160 when socket assembly 106 is constructed. Second housing 130 has walls 166 that extend downward and mate with lower socket 108. Inside second housing 130, upper grooves 168 are longitudinally opposed to one another and extend from one end of second housing 130 to the other end.

Second housing 130 fits over upper socket 114 so that upper socket 114 is fully recessed in the hollow interior of second housing 130. Walls 166 rest against first ledges 128 while upper grooves 168 lock with lower grooves 132 to prevent lateral and longitudinal movement of second housing 130 and first housing 122, relative to one another. Housings 122 and 130 are glued together in one embodiment, although other means for fastening are possible.

In operation and use, multiple socket assembly 106 and connector assembly 20 are identical. Printed circuit board 26 having one or more connector assemblies 20 mounted thereon can be utilized as a means for conveying electrical power, with an amperage of up to about 75 amps. Referring to FIG. 1, a first power supply supplies power through plug or pin connector 59 to second socket 28. Electricity flows from second socket 28 to second pins 58, down into second interconnect holes 30 and then into second trace 34 and on to the remaining circuit. Similarly, an independent and separate power supply provides power through a plug or pin connector 59 to first socket 22. Electricity flows from first socket 22 to first pins 92, down into first interconnect holes 24 and then into first trace 32 and on to the remaining circuit. Soldering pins 92 and 58 to interconnect holes 24 and 30 is one method of securing the connector assembly 20 to the circuit board 26 and providing an electrical coupling between the two. Each power supply may provide differing levels of energy at different times. A plug or pin connecting the power supply to the connector assembly 20 is inserted in either side of each socket 22 and 28.

Power connector assembly 20 is useful for vertical socket displacement of power connectors, saving space on the surface of the circuit board. The advantages include a reduced footprint on circuit boards and configurations for power connectors that are not possible with power connectors aligned side-by-side. Power connector assembly 20 costs less to manufacture than two traditional connectors.

Other embodiments are within the scope of the present invention. Blades can connect the socket assemblies to the circuit boards, rather than pins. Furthermore, sockets can be sized and shaped to receive blade connectors rather than pin connectors. Finally, the present invention includes disposing three or more sockets in vertical alignment.

From the foregoing, it can be seen that a new connector assembly for attachment to a printed circuit board and carrying electrical power has been provided. The connector assembly has a relatively small footprint and vertically disposed sockets. The sockets and pins within the connector assembly are spaced apart and electrically isolated enough from one another to allow power of up to about 75 amps. Vertically spaced-apart sockets relative to the base have portals on each side, providing a variety of power connection configurations.

What is claimed is:

1. A multiple socket power connector assembly for use with a printed circuit board having at least one first trace extending to an array of first interconnect holes in the printed circuit board and at least one second trace extending to an array of second interconnect holes in the printed circuit board comprising a connector housing having a base and a wall extending upwardly from the base, first and second conductive sockets carried by the connector housing in vertically spaced-apart positions relative to the base and being accessible from the wall, a first set of pin members electrically coupled to the first conductive socket and extending downwardly alongside the second conductive socket and through the base, a second set of pin members electrically coupled to the second conductive socket and extending downwardly through the base, the first set of pin members being adapted for engaging the array of first interconnect holes in the printed circuit board and the second set of pin members being adapted for engaging the array of second interconnect holes in the printed circuit board, the connector housing having an internal wall of a dielectric material extending between the first set of pin members and the second conductive socket for electrically insulating the first set of pin members from the second conductive socket.

2. The connector assembly of claim 1 wherein the first set of pin members includes a first plurality and a second plurality of pin members, such first and second pluralities of pin members extending along opposite sides of the second conductive socket.

3. The connector assembly of claim 2 wherein the second set of pin members extends downwardly from the second conductive socket, and the second set of pin members includes a first plurality and a second plurality of pin members.

4. The connector assembly of claim 1 wherein the first and second conductive sockets are each circular in cross-section for receiving a cylindrical pin member.

5. The connector assembly of claim 1 wherein the first and second conductive sockets are concentrically formed about respective first and second centerlines, the first and second centerlines being spaced apart a distance ranging from 0.29 to 0.31 inch.

6. The connector assembly of claim 1 wherein the connector housing has a height ranging from 0.615 to 0.805 inch.

7. The connector assembly of claim 1 wherein the connector housing has a length ranging from 0.61 to 0.7 inch.

8. The connector assembly of claim 1 wherein the second conductive socket is formed from a stamped and formed member.

9. The connector assembly of claim 8 wherein the first conductive socket is formed from a stamped and formed member.

10. A multiple socket power assembly for use with a printed circuit board comprising a housing having a base, a first electrically-conducting body carried by the housing, the first body having a socket portion and a plurality of first pins extending downwardly from the socket portion and through the base, a second electrically-conducting body carried by the housing in vertical alignment with the first body, the second body having a socket portion with first and second sides and a plurality of second pins extending downwardly from said socket portion and through the base, the plurality of first pins extending alongside both the first and second sides of the second body.

11. The socket assembly of claim 10 wherein the socket portion and the plurality of first pins of the first body are integrally formed.

12. The socket assembly of claim 11 wherein the first body is a stamped and formed member.

13. The socket assembly of claim 8 wherein the socket portion of the first body has a wall forming a partial tube with an open segment, the wall having first and second ends, the plurality of the first pins extending from each of the first and second ends of the wall.

14. The socket assembly of claim 10 wherein the socket portion and the plurality of second pins of the second body are integrally formed.

15. The socket assembly of claim 14 wherein the second body is a stamped and formed member.

16. The socket assembly of claim 14 wherein the socket portion of the second body has a wall forming a partial tube with an open segment, the wall having first and second ends, the plurality of the second pins extending from each of the first and second ends of the wall.

17. A multiple socket power connector assembly for use with a printed circuit board having at least one first trace extending to an array of first interconnect holes in the printed circuit board and at least one second trace extending to an array of second interconnect holes in the printed circuit board comprising a connector housing having a base and a wall extending upwardly from the base, first and second conductive sockets carried by the connector housing in vertically spaced-apart positions relative to the base and being accessible from the wall, a first set of pin members electrically coupled to the first conductive socket and extending downwardly alongside the second conductive socket and through the base, a second set of pin members electrically coupled to the second conductive socket and extending downwardly through the base, the first set of pin members being adapted for engaging the array of first interconnect holes in the printed circuit board and the second set of pin members being adapted for engaging the array of second interconnect holes in the printed circuit board, the first set of pin members depending from the base in a first plane and the second set of pin members depending from the base in a second plane spaced apart from the first plane a distance ranging from 0.10 to 0.15 inch.

18. The connector assembly of claim 17 wherein the connector housing has an internal wall of a dielectric material extending between the first set of pin members and the second set of pin members for electrically insulating the first set of pin members from the second set of pin members.

19. A multiple socket power connector assembly for use with a printed circuit board having at least one first trace extending to an array of first interconnect holes in the printed circuit board and at least one second trace extending to an array of second interconnect holes in the printed circuit board comprising a connector housing having a base and a wall extending upwardly from the base, first and second conductive sockets carried by the connector housing in vertically spaced-apart positions relative to the base and being accessible from the wall, a first set of pin members electrically coupled to the first conductive socket and extending downwardly alongside the second conductive socket and through the base, a second set of pin members electrically coupled to the second conductive socket and extending downwardly through the base, the first set of pin members being adapted for engaging the array of first interconnect holes in the printed circuit board and the second set of pin members being adapted for engaging the array of second interconnect holes in the printed circuit board, the connector housing having a width ranging from 0.44 to 0.495 inch.

20. The connector assembly of claim 19 wherein the connector housing has an internal wall of a dielectric material extending between the first set of pin members and the second set of pin members for electrically insulating the first set of pin members from the second set of pin members.

* * * * *